US005328105A

United States Patent [19]

Sims et al.

[11] Patent Number: 5,328,105

[45] Date of Patent: Jul. 12, 1994

[54] TRANSPORTABLE PROCESSING UNIT CAPABLE OF RECEIVING VARIOUS CHEMICAL MATERIALS TO PRODUCE AN ESSENTIALLY HOMOGENEOUS ADMIXTURE THEREOF

[75] Inventors: Donald G. Sims, Washington; Norman Foster, Bloomfield Hills, both of Mich.

[73] Assignee: Nortru, Inc., Detroit, Mich.

[21] Appl. No.: 839,267

[22] Filed: Feb. 20, 1992

[51] Int. Cl.[5] ..... B02C 23/00

[52] U.S. Cl. ..... 241/46.17; 241/101.7; 241/101.8; 366/307

[58] Field of Search ..... 241/46.17, 69, 101.7, 241/101.8, 48; 366/307, 149

[56] References Cited

U.S. PATENT DOCUMENTS

| | | | |
|---|---|---|---|
| 3,630,365 | 12/1971 | Woodbridge . | |
| 3,709,664 | 1/1973 | Krekeler et al. | 366/307 X |
| 4,082,672 | 4/1978 | Petroski . | |
| 4,245,570 | 1/1981 | Williams | 241/48 X |
| 4,344,579 | 8/1982 | Monta et al. | 241/101.8 X |
| 4,377,475 | 3/1983 | Wiedemann . | |
| 4,383,920 | 5/1983 | Muller et al. . | |
| 4,471,916 | 9/1984 | Donaldson | 241/604 X |
| 4,474,479 | 10/1984 | Redelman | 241/292.1 X |
| 4,514,294 | 4/1985 | Layman et al. . | |
| 4,536,286 | 8/1985 | Nugent . | |
| 4,582,264 | 4/1986 | Stephanof et al. | 241/48 |
| 4,735,368 | 4/1988 | Janko et al. . | |
| 4,747,696 | 5/1988 | McCrory et al. | 366/307 |
| 4,798,131 | 1/1989 | Ohta et al. | 366/307 X |
| 4,934,828 | 6/1990 | Janssen | 366/307 |
| 5,005,980 | 4/1991 | Zimmerman | 241/101.8 X |
| 5,007,590 | 4/1991 | Taylor | 241/DIG. 38 |

*Primary Examiner*—Mark Rosenbaum
*Assistant Examiner*—Frances Han
*Attorney, Agent, or Firm*—Basile and Hanlon

[57] ABSTRACT

A transportable processing unit for producing a pumpable, essentially homogeneous admixed material suitable for use as substitute fuel or for thermal destruction by incineration, the processing unit including a closed mixing vessel mounted on a movable base member the vessel adapted to receive feedstock material from an adjacent on site holding facility through at least one entry port and to receive intermediate process material through at least one inlet port and a process material exit port as well as a mixing device located in the vessel interior. The processing unit of the present invention also has a conduit for conveying process material away from said mixing vessel, which is connected to the mixing vessel exit port, and at least one particle sizing device mounted on the moveable base member which has an inlet in fluid communication with a second end of the process material conveying conduit and at least one diverter outlet which is in fluid communication with the intermediate process material inlet port of the mixing vessel. The moveable base is preferably a transportable member such as a tractor trailer or a transportation skid.

7 Claims, 5 Drawing Sheets

TRANSPORTABLE PROCESSING UNIT CAPABLE OF RECEIVING VARIOUS CHEMICAL MATERIALS TO PRODUCE AN ESSENTIALLY HOMOGENEOUS ADMIXTURE THEREOF

BACKGROUND OF THE INVENTION

I. Field of the Invention:

The present invention pertains to a device for processing large volumes of organic waste material from chemical or refinery processes, remediation projects in either a batch or continuous mode. The device is an integrated unit which can be transported from site to site to process or recycle waste materials from various types of chemical manufacture, refinery and processing operations into an essentially homogeneous, substitute fuel on a location at or near the source of the generation or storage of such waste materials thereby eliminating the necessity of transporting large volumes of untreated waste materials to remote, fixed treatment and processing facilities.

II. Description of the Relevant Technology:

In various chemical, refinery and manufacturing processes or environmental remediation projects, a variety of hazardous and non-hazardous waste materials are generated which may require post-generation treatment, separation, or other processing to facilitate waste minimization, disposal, removal, useful product recapture, or recycling. One impediment to the management of such waste materials is the general non-homogeneous, solid or sludge-like nature of such materials. The wastes generally exist as an agglomeration of various solids, liquids, semi-solid and sludge-like components. Depending on composition and chemical make-up, some of the compounds in the waste may be separable and useable in other applications or other processes if they can be recovered. Typically, the wastes are not amenable for reclaiming such useable compounds and are processed to produce materials suitable as substitute fuels for certain kilns, industrial furnaces, boilers and the like which have regulatory approvals to burn such substitute fuels.

In the past such high-volume waste materials were treated and/or stored in drums, tanks, lagoons or the like indefinitely. The large volume and solid, sludge-like nature of the materials precluded transfer to remote facilities for treatment at such remote treatment facilities employing various separation, processing, recycling, reclamation and/or disposal techniques. This practice of indefinite storage has been eliminated presenting the opportunity and necessity to reclaim, recycle, or process these materials at such storage sites and as they are generated at a facility or site.

Even if physical removal was heretofore possible, transport costs for transferring these waste materials to remote processing facilities made this option cost-prohibitive in many high-volume installations. Subsequent Federal regulations made some of these wastes subject to hazardous waste regulation and land disposal restrictions. Thus the need for treating, processing, or removing large volumes of such materials in an environmentally safe manner was greatly increased.

This problem is particularly pronounced with hazardous by-product materials such as the still bottoms and API separator sludges from various petroleum refinery and distillation processes. Also, lagoon cleanup as part of environmental remediation projects produce large volumes of sludge material. These materials, in general, are non-homogeneous sludge-like materials which contain high concentrations of organic compounds, solids and can be extremely dense and/or viscous making them difficult to handle, pump, and transport.

A variety of partial remedies to the shipping and handling problem have been proposed. U.S. Pat. No. 4,082,672 to Petroski discloses a trailer specifically designed for receiving, transporting, and unloading sludges which range in consistency from liquid to semi-solid. The reference fails to provide or suggest any procedure or apparatus for reducing the volume of sludge to be transported for processing or a method for processing the material into useful forms or otherwise recycling the component materials. U.S. Pat. No. 4,377,478 to Wiedeman discloses a mobile apparatus for syphoning and dewatering sludge. While the sludge volume is reduced, the reference fails to disclose any method or apparatus for processing or recycling the dewatered sludge into a useful product.

A variety of waste water treatment methods and apparatuses have been disclosed. U.S. Pat. No. 4,536,286 to Nugent discloses an apparatus which can process the contents of the storage lagoons containing water and up to 15% solids processed by the Nugent apparatus which removes the solids present in the waste stream and reduces this stream by dewatering by up to 75% of the original volume. This operation is performed by a transportable waste treatment apparatus composed of a pair of mixing tanks in which the waste stream is negatively charged and admixed with a suitable flocculent. The Nugent device also includes a settling tank equipped with a plurality of baffles as well as multiple sludge drain-off means. Once appropriate settlement and separation has occurred, the Nugent device anticipates that the separated water can be discharged directly into a suitable effluent stream while the collected concentrated solids are removed for appropriate disposal. U.S. Pat. No. 4,383,920 to Muller et al discloses a self-contained mobile system for purifying aqueous liquids which involves the sequential contact of the liquid with various ion exchange media contained in separate reaction vessels which are housed in a reclaiming or recycling the resulting sludge. Furthermore, neither reference is effective in treating non-aqueous materials.

U.S. Pat. No. 3,630,365 to Woodbridge discloses a mobile liquid waste treatment system adapted to be positioned on a series of rail cars and brought to the contaminated site. The Woodbridge apparatus includes a mixing vessel, a series of biochemical reaction tanks, a centrifuge, filter unit with means for removing separated solids and an irradiation unit for exposing the treated liquid to predetermined doses of gamma radiation. This system is specifically designed to augment existing waste water treatment facilities.

A trailer-mounted apparatus designed specifically for decontaminating PCB-containing hydrocarbons is proposed in U.S. Pat. No. 4,514,294 to Layman et al. The device includes reaction vessels capable of receiving de-watered hydrocarbons and raising the hydrocarbon temperature to about 130° C. and directing the material through an injector into a stoichiometric quantity of sodium. The device is equipped with appropriate heat exchangers as well as suitable heating units, PCB monitoring units, and recirculating devices to re-inject the hydrocarbon stream until the PCB level is lowered by the desired amount. The apparatus also includes suitable sodium separators as well as hydrocarbon filters. This device is specifically designed for the chemical destruction of PCB and fails to provide a recycling method for still bottoms and the like.

Thus, despite a great deal of activity in producing mobile water purification devices and site-specific chemical purification devices, no mobile or skid-mounted device has been proposed which can be employed to handle and process materials such as solids, semi-solids, or pumpable sludges on site. Moreover no device has been developed which will process such material in a manner which recylces such hazardous and non-hazardous organic material into suitable substitute fuel materials.

It is desirable to provide an apparatus and method for permitting effective processing of recyclable components of a waste stream for formulation into a useful substitute fuel product or to make the wastes more amenable for movement or removal to an incineration facility for thermal destruction of the materials. It is also desirable that the apparatus employed be mobile and/or skid-mounted and readily transportable to the waste generation or storage site.

SUMMARY OF THE INVENTION

The present invention is a transportable processing unit capable of producing a pumpable, essentially homogeneous admixed chemical material suitable for fuel substitution in certain kilns and industrial furnaces or for movement to an incinerator for thermal destruction from a variety of potentially disparate organic waste sources and a process for making such an admixed chemical material. The organic waste sources can be any undesirable or non-useful by-products of various chemical or refinery processes or wastes resulting from environmental remediation projects. Ideally, at least a portion of those organic waste materials handled by the processing unit of the present invention are those which but for this processing would be considered to be extremely difficult to handle and process to accomplish environmentally responsible and regulatory-acceptable disposition of these materials. Typically, such materials are solid, semi-solid or sludge-like materials which are not readily pumpable or otherwise transportable.

The product produced by the processing unit of the present invention may be an admixed material capable of use as a substituted fuel in cement kilns, industrial furnaces, special use generation facilities and the like. Other uses for specific products produced by the processing unit of the present invention may become obvious to one skilled in the art upon reading the accompanying disclosure.

The processing unit of the present invention is a self-contained device mounted on at least one moveable base member adapted to be transportable to the location of the storage or generation of large volumes of organic waste materials. Once on site, the processing unit of the present invention can be releasably connected to the waste or by-product storage source or integrate directly into the by-product or waste generation stream to receive feedstock material therefrom. In this fashion the processing unit can operate in either a batch or continuous operating mode. Processing can continue as necessary. Once complete, the processing unit of the present invention can be removed and transported to a new location.

The processing unit of the present invention includes an underlying base member capable of maintaining essential processing equipment securely fastened thereto. The base member can be a suitable transportation skid or a tractor trailer chassis suitable adapted to support the processing equipment and an associated volume of process stream being treated thereby.

The processing equipment mounted thereon includes a closed mixing vessel capable of receiving a volume of feedstock material to be processed, a conduit for conveying contents of the mixing vessel away from the mixing vessel, and at least one suitable particle sizing device also mounted on the transportable base adapted to receive the content of the conduit. The feedstock material may contain significant percentages of solid material capable of being reduced to a particulate form which is dispersable and/or suspendable in the surrounding fluid material. Reduction to particulate form and dispersion/suspension is accomplished by the action of mixing mechanisms contained in the mixing vessel and by the particle sizing device.

The processing unit of the present invention also has a diverter outlet in fluid communication downstream of the particle sizing device. The diverter outlet has a first branch which connects back to the mixing vessel and a discharge second branch for egress of process material from the production unit into a suitable external receptacle. The diverter outlet also has means for channelling the process stream between the two branches.

The processing unit of the present invention can also include a self-contained, positive pressure laboratory permanently attached to the movable base member into which data derived from various sensor units attached at various positions throughout the unit can be fed and analyzed. In this manner, the quality and composition of incoming feedstock as well as intermediate and outgoing process material can be monitored and modified as necessary.

BRIEF DESCRIPTION OF THE DRAWING

In order to more fully understand the transportable processing unit of the present invention, reference will be made to the following drawing in which like reference numerals refer to like elements throughout the several drawing figures and in which.

DETAILED DESCRIPTION OF THE PREFERRED EMBODIMENT

The present invention is a transportable processing unit which facilitates the on-site processing of organic waste materials, generated by various chemical processing or refinery operations or environmental remediation projects, by chemical treatment, maceration, shearing, and blending of the organic waste material into a resulting pumpable, essentially homogeneous material which can contain a solids portion in an amount up to about 60% by composition weight. The by-products or waste material processable as feedstock by the transportable processing unit of the present invention are received from a generating or storage facility to which the unit of the present invention is transported.

At least one portion of the feedstock material may be composed of solid organic material. As used herein, the term "solid" is defined as encompassing sludge-like materials having a viscosity greater than about 5000 cps as well as materials which are more conventionally thought of as solids. Suitable solid feedstock may include organic materials such as long-chain hydrocarbons, macromolecular materials, polymeric materials and the like. Where the resulting process material is to be used as a fuel substitute, the solid materials are to be those which can be consumed in certain combustion processes. The solids portion may also include inorganic or organo-metallic material such as grit which can be consumed in combustion processes without the generation of excessive amounts of undesirable by-products of combustion. As used herein, the term "solids" also includes materials such as still bottoms, slop oil emulsion solids, API operator sludge, lagoon sludge, vacuum filter residue, filter belt residue, filter press cake, as well as other suspendable or dissoluable organic-laden substances. These materials can be supplied to the process unit of the present invention in either a continuous or batch process in a manner which will be discussed subsequently.

A second portion of the feedstock material is an organic or organo-aqueous liquid containing less than about 30% by weight total solids which is readily miscible with the first feedstock material and is capable of dispersing the solids-containing material therethrough. As with the first feedstock material, the second feedstock material is one which can be consumed in the combustion process. The second feedstock material can be derived from the generation site in a batch or continuous process.

Figure 1:
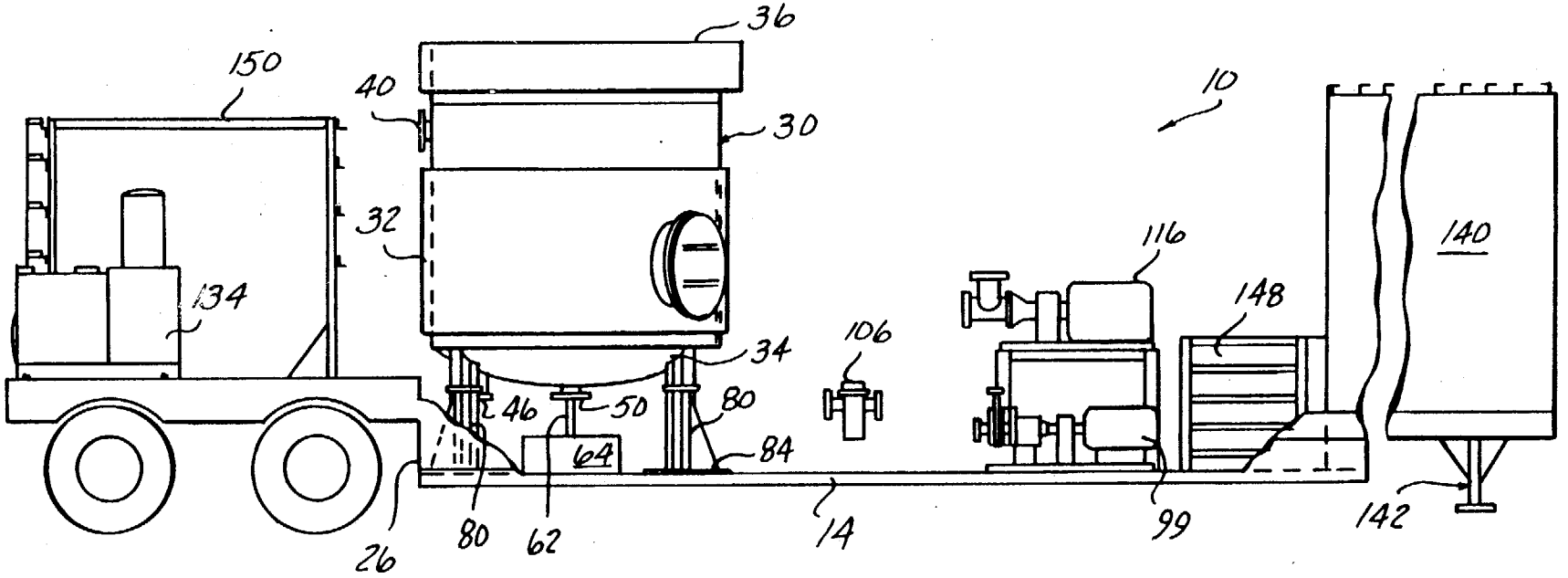
FIG. 1 is a elevational view of one embodiment of the transportable processing unit of the present invention as mounted on a tractor trailer chassis with the process material conveying conduit omitted for clarity.

As shown in FIG. 1, the transportable processing unit 10 of the present invention is constructed on at least one moveable base member 12. The moveable base member 12 is composed of a pair of parallel, longitudinally disposed beam members 14, 16, and a pair of parallel latitudinally disposed beam members 18, 20 connected perpendicularly to the longitudinally disposed beam members 18, 20 to define an essentially rectilinear platform frame. The moveable base member 12 may also be suitable reinforcement braces extending between the respective beam members (not shown) to provide the necessary support and stability to the elements mounted thereon to permit mounting of the various processing elements thereon and to permit safe transport of the processing unit 10 over rail or highway and off-road, if necessary.

The moveable base member 12 also has a suitable planar floor 22 overlaying and mounted to the rectilinear platform area. The floor 22 may be made of any sturdy material which is suitable for use in a chemical processing environment. In the preferred embodiment, the floor 22 is constructed from conventional low-carbon steel plates of nominal ¼" thickness. The moveable base member 12 also has a plurality of upwardly extending wall members 24 sealingly connected to the floor 22 and angularly oriented thereto preferably defining an interior angle of approximately 90°. Taken together, the upwardly extending wall members 24 and the floor 22 define a containment region having an interior volume greater than the fluid-containing devices of the processing elements enumerated subsequently which are mounted on the moveable base member 12. Should a fluid leak occur during operation of the processing unit 10 of the present invention, the process material would be contained in the containment region to preclude release into the surrounding environment.

The moveable base member 12 of the present invention may be any rigid or semi-rigid device which is readily transportable to remote processing sites. It is envisioned that the processing unit 10 of the present invention would most likely be transported overland by either rail or tractor trailer. Thus, the moveable base member 12 of the transportable processing unit 10 of the present invention can be either a tractor-trailer chassis, such as the drop-floor chassis 26 shown in FIG. 1, which can be releasably coupled to a suitable automotive truck cab (not shown), or a moveable skid, (also not shown) which can be lowered onto a separate chassis of a tractor-trailer, railcar or the like. In applications where the transportable unit is to remain in a fixed position for an extended time period, it is to be appreciated that a skid-mounted unit may be more economical and practical.

The moveable mounting base member 12 of the present invention can also have suitable leveling and stabilizing devices associated therewith to permit its operation in less than optimal terrain. These can include suitable foot pads and the like. In the embodiment shown in FIG. 1, the stabilizing devices can include trailer landing gear reinforcements and the like (not shown). In general, the moveable base member 12 of the present invention can include leveling devices (not shown) which include plates capable of providing distribution of the weight of the processing unit 10 transferred by associated leveling jacks to underlying surfaces. The plates can be employed with particular success in non-paved areas. Leveling jacks and their plates can be located as needed on the moveable base member 12. Preferably, there are four jacks at or near the respective base member 12 corners with suitable reinforcement regions on the base member where the jacks are located. Additional leveling jacks may be employed as needed. For example, additional jacks may be employed in the front of a low-boy trailer at or near the landing gear 142 to further stabilize a processing unit 10 so configured. The jacks may be of any suitable type such as hydraulic, mechanical or the like.

The processing unit 10 of the present invention includes a mixing vessel 30 permanently mounted thereon. Factors affecting the positioning of the mixing vessel 30 on the moveable base member 12 include weight distribution and optimization of process simplicity. In the preferred embodiment, the mixing vessel 30 is positioned to overlay or be located proximate to a suitable load-bearing member, for example in the embodiment of FIG. 1, the front axle. The mixing vessel 30 is also, preferably, positioned within the containment region defined on the base member 12. In this manner, any leakage of process material attributable to a breach in the integrity of the mixing vessel 30 would be contained; thus precluding undesirable releases into the surrounding environment.

The mixing vessel 30 is, preferably, a closed cylindrical vessel having sufficient internal capacity to process organic waste materials in a continuous, near-continuous or batch fashion. In the embodiment shown in FIG. 1, the vessel has an internal volumetric capacity between about 1200 gallons and about 2000 gallons.

Figure 3:
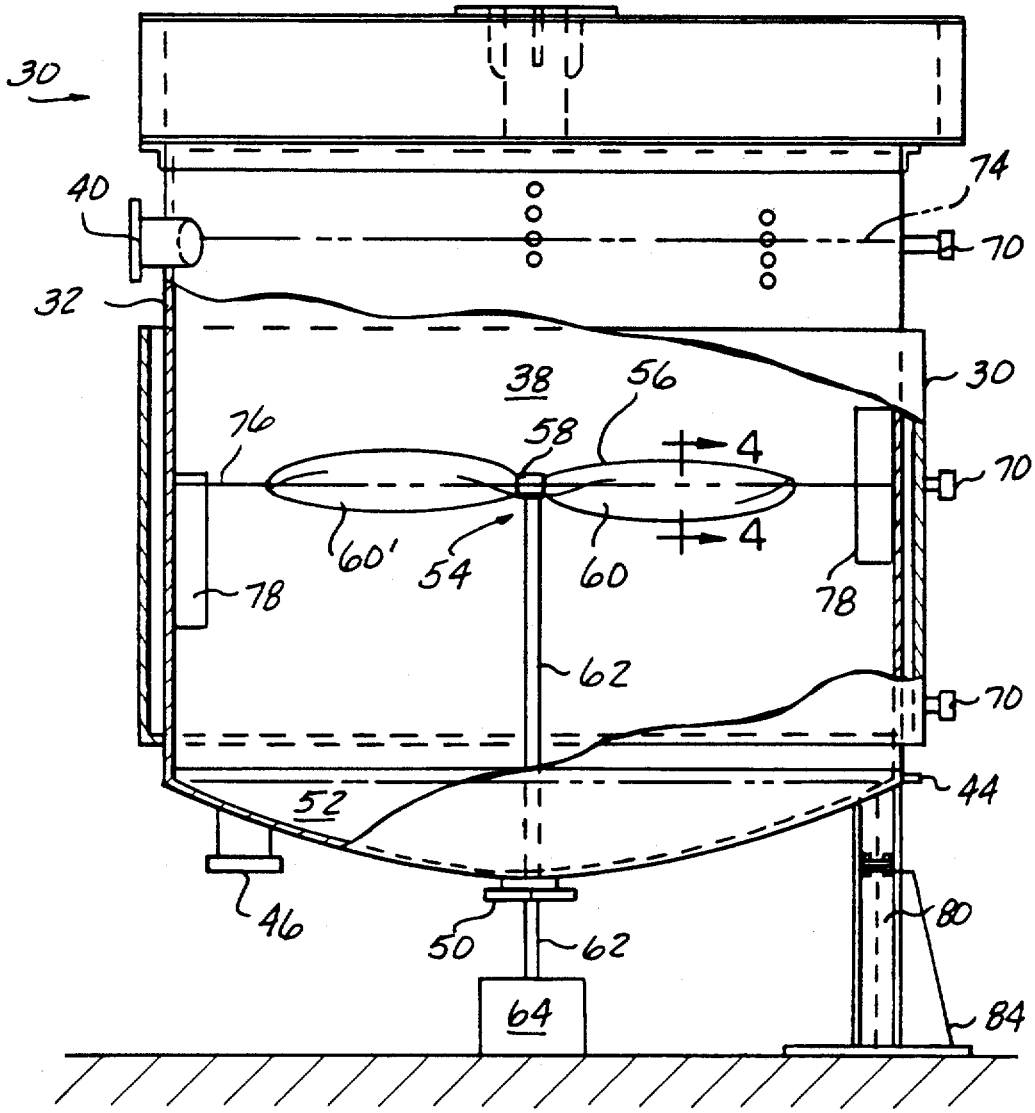
FIG. 3 is a partial cross sectional view of the mixing vessel of the transportable processing unit of FIG. 1 taken along the 3—3 line.

The mixing vessel 30 has an external housing made of any suitable structural material such as steel which may be steam jacketed if desired. The housing of the mixing vessel 30 is generally defined by a cylindrical side wall 32 having a bottom wall member 34 contiguously attached thereto. Together with an upper wall member 36, the side wall 32 and the bottom wall 34 define an interior mixing area 38 as shown in FIG. 3, into which the feedstock materials are introduced. The bottom wall member 34 can have any suitable configuration which would facilitate mixture and processing of the contents. In the embodiment as shown in FIG. 1, the bottom wall member 34 has a substantially concavely contoured interior surface as shown in greater detail in FIG. 3.

The mixing vessel 30 has a plurality of inlets to permit introduction of feedstock material into the interior mixing area 38. In the embodiment as shown in FIG. 1, these inlets include at least one entry port 40 for receipt of feedstock material therethrough. The entry port 40 is, preferably, located at any suitable location in the vessel side wall 32 and can be placed in fluid communication with a waste transfer mechanism, waste generating process or storage location in a manner which will be discussed in greater detail subsequently. The entry port 40 has sufficient area to permit efficient introduction of the feedstock material.

Figure 2:
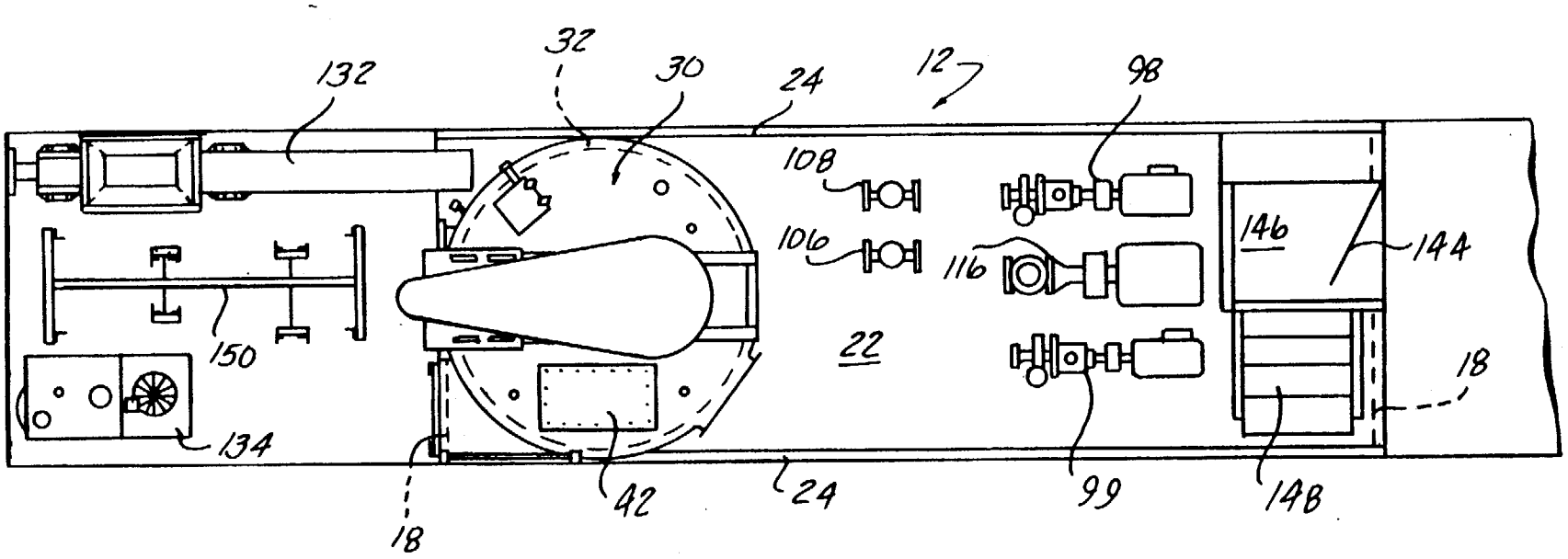
FIG. 2 is a top view of the transportable processing unit of FIG. 1.

In the preferred embodiment, the feedstock introduced through entry port 40 is a pumpable liquid capable of being introduced under pressure into the interior area 38 of the mixing vessel 30. In situations where all or a portion of the feedstock material is incapable of introduction in this manner, the material can be introduced into the mixing vessel 30 through an auxiliary feedstock entry port 42 preferably located in the upper wall member 34 shown in detail in FIG. 2. In such instances, it is envisioned that materials having high solids content would be mechanically introduced into the mixing vessel 30 using an auger, conveyor, or similar mechanism. The solids conveyance mechanism will be described in greater detail subsequently. The auxiliary feedstock entry port 42 is, preferably, a suitable closeable hatch which can be opened as needed to receive introduced solid feedstock material.

The mixing vessel 30 also has an inlet port 44 for receipt of intermediately processed material. The inlet port 44 is, preferably, located in the cylindrical side wall at a height sufficient to permit reintroduction of process material previously removed from the mixing vessel 30 for additional processing. The inlet port 44 is, preferably, located at a position in the lower third portion of the cylindrical side wall 32.

The mixing vessel 30 also includes an exit port 46 which is in fluid communication with a process material conveying conduit attached thereto. The exit port 46 permits removal of admixed feedstock material after it has been adequately processed. The material can, then, be conveyed through the process material conveying conduit 48 to subsequent processing stations which will be discussed in greater detail subsequently. The exit port 46 is, preferably, located in the cylindrical side wall 32 at a location essentially proximate to the mixing region to be described.

The mixing vessel 30 of the present invention may also include a separate cleanout port 50 located in the bottom wall member 34. The cleanout port 50 can be releasably attached to any suitable transfer receptacle (not shown) to facilitate removal of non-mixable solids which settle out during the mixing process. To facilitate this, the bottom wall member 34 defines a substantially concave lower region 52 as shown in FIG. 3, in the defined interior mixing area 38. This essentially concave lower mixing region 52 permits accumulation of non-suspendable solid material for later collection and separation. In the preferred embodiment, it is anticipated that such non-suspendable solid material would consist of metal fines, rocks, and the like. Removal of this undesirable material facilitates the later processing and use of the resulting homogeneous admixed material.

The mixing vessel 30 includes a suitable mixing mechanism 54 positioned centrally in the interior mixing area 38. The mixing mechanism 54 includes at least one rotary blade unit 56 as illustrated in FIG. 3. The rotary blade unit 56 is oriented essentially perpendicular to the cylindrical side wall 32 and has a central pivot head 58 and a plurality of individual blades 60, 60' attached to the pivot head 58 extending radially outward therefrom. The rotary blade unit 56 is mounted on the first end of a drive shaft 62 which itself is rotatable around a central axis A projecting from top to bottom through the center of the mixing vessel 30. The drive shaft 62 can be powered by any suitable means for imparting rotational movement which is in engagement with a second end of the drive shaft 62. In the preferred embodiment, the means for imparting rotational movement 64 is a suitable motor located exterior to the mixing vessel 30 and mounted directly to the moveable base member 12. The drive mechanism 64 which is chosen is, preferably, explosion-proof and capable of prolonged operation at low and intermediate revolution rates. The drive mechanism 64 may be powered by an suitable external power source (not shown).

The rate of rotation of the rotary blade unit 56 is one which permits mixing and shearing of solids present in the feedstock material introduced into the mixing vessel 30 in a manner to produce an essentially stable solid-liquid suspension. Heretofore, it was widely held that the production of stable suspensions containing sludge components could only be accomplished with rapid mixing and agitation at high rpm values. The processing unit 10 of the present invention utilizes the unexpected discovery that low to intermediate speed mixing can achieve superior suspension results in materials having high solids content. In the preferred embodiment, the solid-liquid suspension can be achieved by prolonged mixing at rotational speeds at or below about 1000 rpm with a rotational speed between about 500 and about 800 rpm being preferred. The mixing interval is that time sufficient to achieve an average particle size below about 20 microns and a viscosity between about 500 cps and about 3000 cps. The term "essentially stable solid-liquid suspension" is defined as a material containing about 50% by weight solids which exhibits no greater than about 20 to about 40% solid-liquid stratification after 24 hours.

Figure 4:
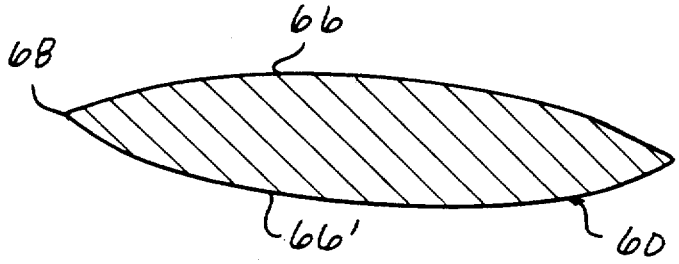
FIG. 4 is a cross sectional view of one blade of the rotary blade unit of FIG. 3 taken alone the 4—4 line.

The rotary blade unit 56 of mixing vessel 30 may have any configuration which facilitates thorough mixing of the sludge material and suspension of solids therethroughout. In the preferred embodiment as shown in FIG. 4, each of the radially extending individual blades 60 has a pair of opposed turbulence-inducing faces 66, 66' which are joined to one another in a suitable manner to form a leading edge surface 68 adapted to pass through the process material contained in the mixing vessel 30 shearingly engaging solid components contained therein.

In the preferred embodiment, the rotary blade unit is oriented in the interior mixing area 38 to create a turbulent mixing region adjacent to the upper surface of the feedstock material extending downward therefrom. The rotary blade unit 56 is positioned such that a lower settlement region is also created in the feedstock material. This settlement region has sufficient volume to permit the eventual settlement and sedimentation of any non-maceratable solids from the process material. In the preferred embodiment, the exit port 46 is positioned to be in fluid communication with or adjacent to the turbulent region. The cleanout port 50 is positioned in the sedimentation region 52.

In order to ensure safe and efficient operation of the processing unit of the present invention, the mixing vessel 30 can also be equipped with suitable level indicating devices and redundant level probes. As is best shown in FIG. 3, the level indicating devices and redundant level probes may be positioned in a plurality of nozzle ports 70 which are triggered when the feedstock level in the mixing vessel 30 reaches a predetermined upper level 74, a lower level 76 or a bi-hi level to prevent overfilling. These devices may be any suitable indicating and shutoff device. In the preferred embodiment, the mixing vessel 30 of the present invention is equipped with 4–20 mA differential pressure level indicating devices and level probes. The device also includes a small programmable logic controller which takes the inputs and produces outputs to appropriate control relays to control the operations of various feedstock introduction mechanisms to maintain a suitable level of material in the mixing vessel 30 at all times during operation or, in the event of failure of the feedstock introduction devices or inability to introduce additional material into the mixing vessel, shutdown mixing operations entirely.

The mixing vessel 30 can also be equipped with suitable motion sensors (not shown), load cells (not shown), sampling ports, analytical probes (not shown), etc. to provide data on the viscosity, density and various other chemical characteristics of the contents of themixing tank. The sensors and probes can be so configured to provide remote data readout and interactive control of the mixing vessel 30 with various other processing devices and feed lines contained in the processing unit of the present invention. In the preferred embodiment, the remote data is collected and monitored in an onboard laboratory which will be discussed in greater detail subsequently.

The mixing vessel 30 can also include appropriate turbulence-inducing baffles 78 which are mounted on the side wall 32 of the mixing vessel 30 and extend inward therefrom into the interior mixing area 38. The baffles 78 are configured to contact a portion of the process material contained in the mixing vessel 30 as it passes thereby and induce further agitated movement in the process material by disturbing the rotational momentum induced therein.

The mixing vessel 30 can be mounted on the movable base member 12 in a suitable vibration-resistant manner. In the embodiment as shown in FIG. 1, the mounting means includes a plurality of reinforced leg braces 80 which are permanently attached to the outer surface of the mixing vessel 30 at an upper end 82 and permanently attached to the movable base member 12 at a lower end 84. In the preferred embodiment, the drive mechanism 64 for the rotary blade unit 56 is located centrally under the mixing vessel 30 with the drive shaft 62 extending perpendicularly upward therefrom into the interior mixing area 38. The elevation of the mixing vessel 30 tank above the movable base member 12 is sufficient to permit routine maintenance of the underside of the mixing vessel 30 and the associated drive mechanism 64 while maintaining a maximum height which will permit the easy transport of the processing unit of the present invention over land. Thus, the height of leg braces 80 can be determined given these parameters.

Figure 5:
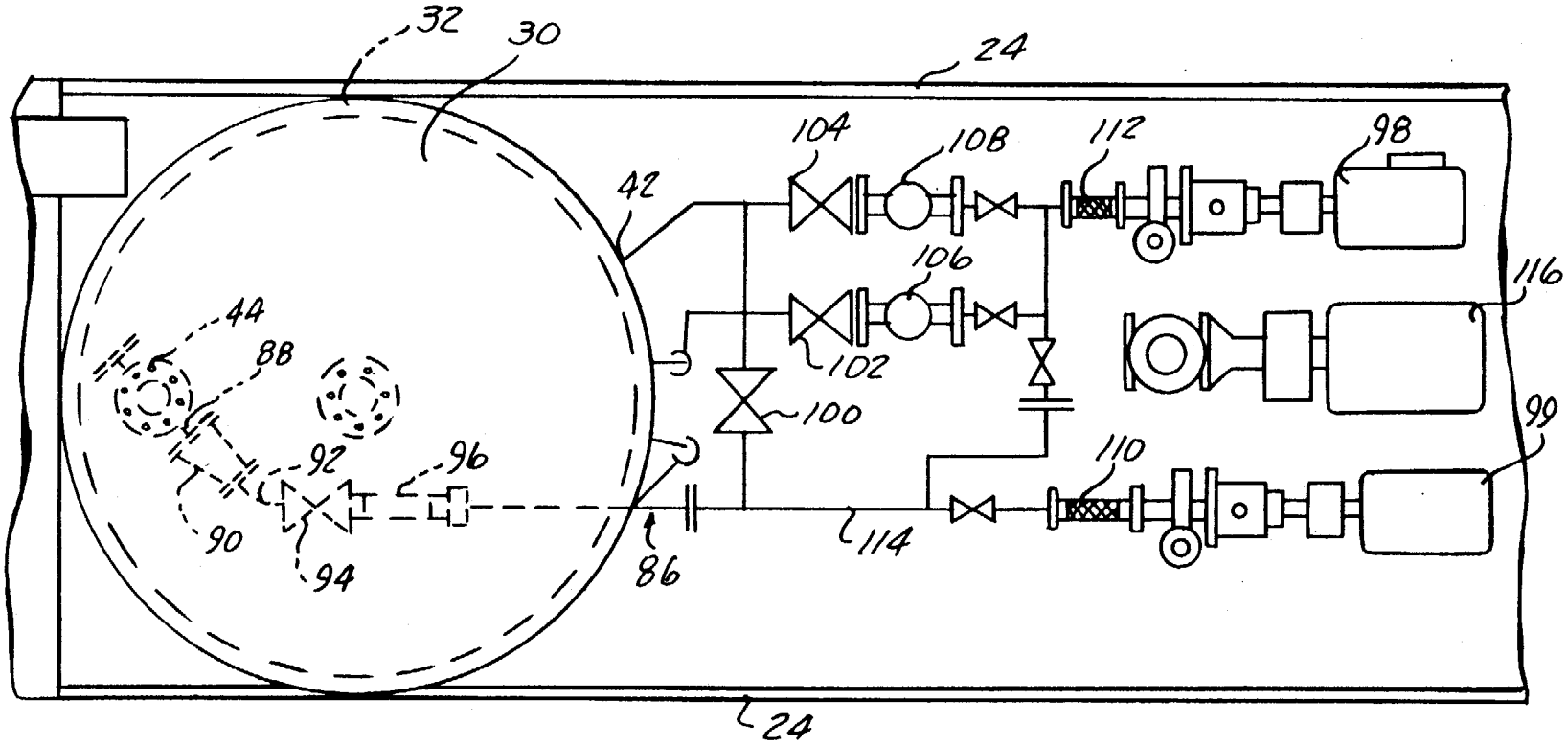
FIG. 5 is a schematic plan view of the process material conveying conduit of the present invention.
Figure 6:
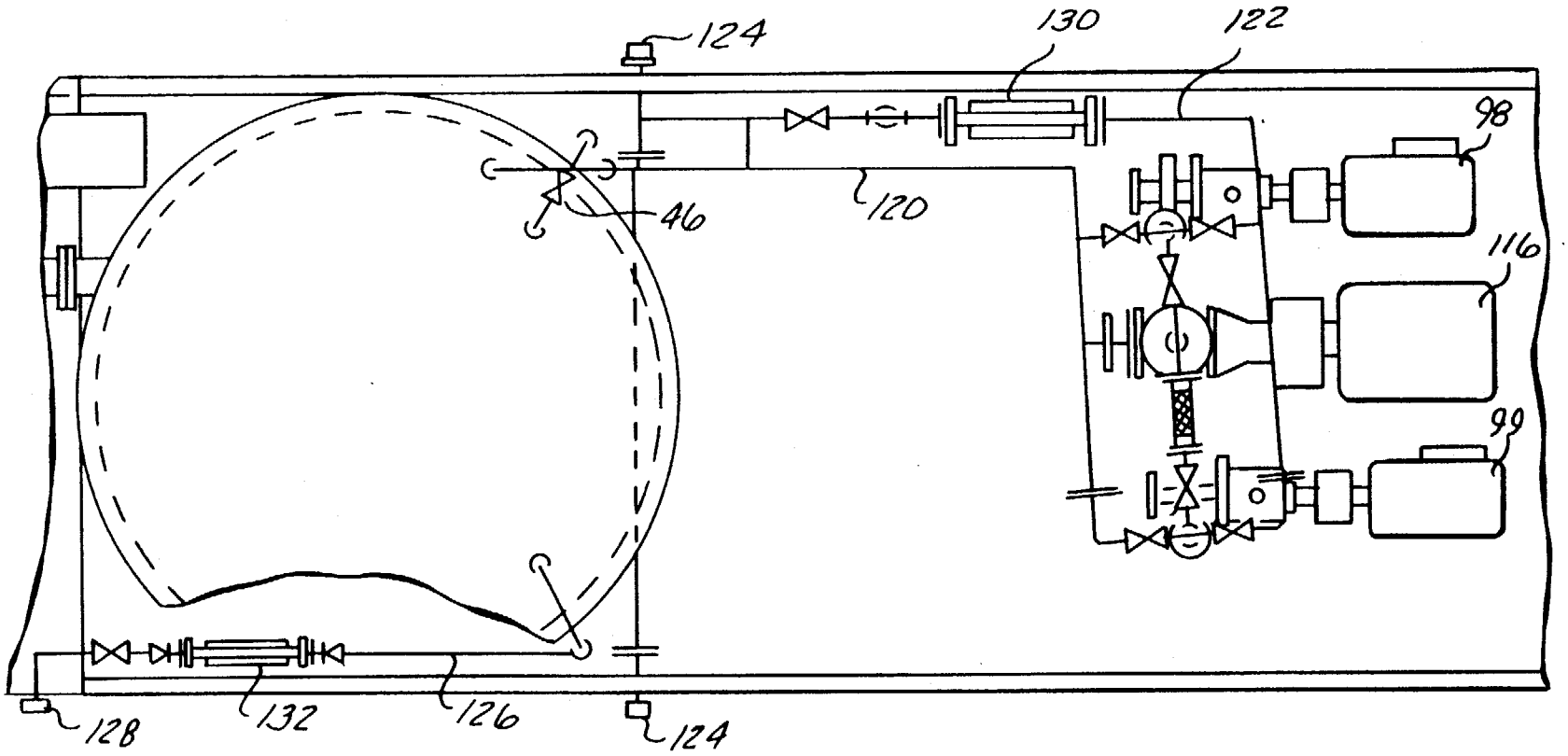
FIG. 6 is a schematic plan view of the process material conveying conduit of the present invention.

As shown in FIG. 5, the processing unit of the present invention also includes a conduit 86 for conveying process material away from the mixing vessel 30 for subsequent processing or other disposition. The conduit 86 has a first end 88 which is in fluid communication with the mixing vessel and attached thereto at exit port 46. The conduit may consist of any suitable non-reactive material. In the preferred embodiment as shown in FIG. 6, the conduit may be composed of several different elements. Taken in the preferred flow direction, these can include a suitable flanged reducer 90 coupled to an appropriate flanged piping member 92 which itself is coupled to an appropriate ball valve 94 to control fluid flow from the mixing vessel 30. The conduit 86 also includes a section of flexible tubing 96 located proximate to the first end 88. The flexible tubing may be constructed of any material which will permit expansion, contraction and limited movement of the conduit during transport of the processing unit 10. In the embodiment as shown, the flexible tubing 96 is made up of braided flexible hose. The conduit 86 can include suitable diverters to direct the fluid flow stream to an appropriate pumping mechanism 98.

In the preferred embodiment, the processing unit 10 of the present invention includes a pair of pumping mechanisms 98 which are connected to the process material conveying conduit 86 at their respective suction ends. Process material can be diverted from one pump to another by means of valves 100, 102, 104. Each pump 98 has a basket strainer 106, 108 located immediately upstream of the suction end. The basket filter 106, 108 provides a means for eliminating undesirable solid elements which could damage the pumping device such as rocks, or the like from the process stream. In the preferred embodiment, the basket filter 106, 108 is capable of eliminating solid material having a particulate diameter greater than about ¼".

As shown in FIG. 5, the process material conveying conduit 81 also includes at least one section of flexible conduit 110, 112 located immediately prior to the suction end of the respective pumps 98, 99. The flexible tubing 110, 112 also serves to isolate the pumps from excessive vibration or movement which would occur during transport of the processing unit 10.

The pumps 98, 99 employed in the processing unit of the present invention can be any type of device capable of conveying process material containing suspended solids in an amount between about 20% and about 80% by total composition weight or an essentially stable solid-liquid suspension from the mixing vessel 30. In the preferred embodiment, the pumps 98, 99 are centrifugal pump devices capable of generating a discharge pressure of about 100 psi and conveying about 200 gallons per minute therethrough. In order to ensure reliable operation, the processing unit of the present invention is, preferably, equipped with an initial pump 98 and a redundant pump 99 to permit continuous operation during pump or filter maintenance.

The conduit 86 can also include a bypass section 114 connected to a secondary pump 99 which permits removal of material contained in the mixing vessel 30 without directing the process material through either prefilter.

From the pump discharge, the process material is conveyed to at least one particle sizing device 116 which is mounted on the moveable base member 12 and has an inlet in fluid communication with the second end 118 of the process material conveying conduit 86. The process material is directed through the particle sizing unit 116 to an appropriate diverter outlet which has a first branch 120 in fluid communication with the intermediate process material inlet port 44 of the mixing vessel 30. The device also has a second discharge branch 122 which communicates with a discharge coupling member 124 which is mounted in an accessible region of the processing unit 10.

The particle sizing unit 116 which is associated with the pump units 98, 99 further ensures that appropriate particle sizing is achieved. The particle sizing device 116 of the present invention includes a housing having an inlet in fluid communication with the second end of the process material conveying conduit 86 as well as an outlet to the diverter valve. The particle sizing unit of the present invention also includes a means for macerating or pulverizing the desirable or processable solid elements contained in the process material. The maceration means can be any suitable device such as an impeller or a grinding auger. One such particle sizing unit which can be successfully employed herein is commercially available under the tradename GREERCO.

The pumps 98, 99 and the particle sizing unit 116 can be powered by any suitable means. In the preferred embodiment, it is anticipated that these units will have electrical motors and will receive their power from an external electrical distribution source or generator.

The processing unit of the present invention can also include a separate sampling or fluid removal conduit 126 having a first end in fluid communication with the mixing vessel 30 and a second end in communication with an auxiliary discharge port 128. Both the main discharge branch 122 and the auxiliary discharge 126 can be equipped with suitable flow meters or measuring devices such as micromotion flow sensors 130, 132.

In the preferred embodiment, the mixing vessel 30, pumps 98, 99 and particle sizing unit 116 are all mounted on one moveable base member 12. In the embodiment shown in the drawing figures, the moveable base member 12 can also include means for introducing feedstock material directly into the mixing vessel 30. The introduction means may be a conveyor device such as an auger or belt apparatus (not shown) or it can be any type of pump capable of conveying semi-solid or sludge-like materials having viscosities up to and including about 30,000 cps and solids contents up to about 70% by weight. These pumps can be any of a variety of commercially available V-ram pumps or piston pumps such as the Schwing concrete pump. In the embodiment as shown in the drawing figures, the feedstock introduction means includes a V-ram pump 132 which is detachably mounted to the moveable base member 12. The V-ram pump 132 can be removed from the base member and placed in fluid communication with the interior of the mixing vessel by using auxiliary piping. The pump 132 may be driven by any suitable drive source. In the preferred embodiment, the pump 132 is driven by a hydraulic pump 134 which itself may be mounted to the moveable base member and can be powered by an external power source.

The processing unit of the present invention can also include means for introducing liquid diluent and suspension-enhancing agents into the process stream. These introduction means can be mounted on the same moveable base member as the mixing vessel if space permits. Alternately, the introduction means can be separately mounted and connected to the main processing unit at the processing site. The mixing vessel 30 of the present invention may include a separate inlet port for the introduction of suspension-enhancing agents.

Where employed, the suspension-enhancing agents may be an admixture of various miscible organic compounds which act to achieve the physical characteristics desired in the resulting essentially stable solid-liquid suspension. The additive consists essentially of anionic or non-ionic dispersants, depending on the waste characteristics of the feedstock material. One such dispersant used successfully consists essentially of dodecylbenzene sulfonic acid; an emulsifier selected from the group consisting of carboxylic acids having between 6 and 12 carbon atoms; anionic and non-ionic surfactants; and other additives such as antifreeze material and the like.

The processing unit 10 of the present invention may also include a self-contained laboratory and control center 140 which may be located on the same moveable base member 12 as the mixing vessel 30 or can be separately mounted and connected thereto at the processing site. The control center is preferably a climate-controlled, explosion-rated, positive pressure building designed to house starter panels, relays, readout terminals and controllers for the various gauges, flow controllers, weight recorders and monitors which would be located throughout the unit. The control center can also house computer control units for controlling the entire blending process as well as any analytical and testing equipment necessary for processing and quality assurance. As shown in the drawing figures, the control center 140 can be mounted on the chassis 26 at a location overlying the trailer chassis landing gear 142. Access to the control center 140 can be gained through a door which opens outward onto an observation platform 146 accessible by a short flight of stairs 148.

As space permits, the processing unit 10 of the present invention can also have a pipe rack 150 mounted proximate to the hydraulic pump unit 134. Various piping can be mounted on the pipe rack. It is anticipated that the piping mounted thereon would be useful in connecting the feedstock introduction device to the mixing vessel and further connecting the feedstock introduction device to the feedstock storage or generation site.

In the process of the preferred embodiment, feedstock materials which are either produced or stored at a site can be transferred directly into the mixing vessel 30 of the processing unit 10 from suitable on-site storage vessels, containment units, or directly from a process or byproduct stream. Once in the mixing vessel 30, the feedstock material can be admixed with sufficient diluent or prior process material to provide a fluid material having between about 20 and about 80% by weight solids suitably dispersible therein; with a solids range between about 40% and about 55% by weight being preferred. The admixed material is further subjected to further particle sizing in the maceration unit 16 located downstream of the mixing vessel. The resulting material can be employed as a substitute fuel having specific characteristics of viscosity, solids content and BTU value. Any portion of the resulting material which fails to meet the specification values can be returned for additional mixing and/or processing. In the preferred embodiment, the resulting substitute fuel will generally have a density between about 7 lbs. per gallon and about 9 lbs. per gallon, a viscosity between about 500 cps and about 3000 cps, and a particle size no greater than about 20 microns.

It is to be appreciated that such materials can successfully be used as a substitute fuel in certain kilns, boilers or industrial furnaces where it can be burned for energy recovery. Alternately, the material could now be transported to a remote incineration site where it could be incinerated to accomplish thermal destruction of the material if that was desirable.

It is to be understood that the content of processed materials for use as substitute fuel can vary greatly and still remain within the parameters defined previously. Thus, it is anticipated that the process of the present invention may include the further steps of admixture of the process material with suitable diluent or with the suspension-enhancing agents previously described. The amount of diluent would be that amount necessary to produce the desired viscosity to enable the material to be pumpable. The amount of suspension-enhancing agents employed would vary depending upon the characteristics of the feedstock material. It is anticipated that some materials may be capable of stable suspension without the admixture of the suspension-enhancing agents.

What is claimed is:

1. A transportable processing unit for producing a pumpable, essentially homogeneous admixed liquid material having a viscosity between about 500 and about 3000 cps, the processing unit comprising:

a unitary movable base member;

a closed mixing and shearing vessel mounted on said base member, said closed mixing and shearing vessel having at least one entry port for receipt of feedstock material, at least one inlet port for receipt of intermediate process material, an exit port for removal of intermediate and final process material, and a cleanout port for removal of non-suspendable solid material, said cleanout port located at an elevation lower than said exit port, said vessel including:

(a) a cylindrical side wall having an inner wall surface and an outer wall surface;

(b) a bottom wall member sealingly attached to said cylindrical side wall;

(c) an upper wall member sealingly attached to said cylindrical side wall at a position opposed to said bottom wall member, such that said cylindrical side wall, said bottom wall member, and said upper wall member define an interior mixing area;

(d) at least one rotary blade unit oriented essentially perpendicular to said cylindrical side wall, positioned in said mixing vessel interior at a height sufficient to create an upper turbulent region and a lower settlement region below said rotary blade unit proximate to said bottom wall member of said mixing vessel, wherein said exit port is positioned to be in fluid communication with the turbulent region and said cleanout port is positioned in the settlement region, said rotary blade unit having a central pivot head and a plurality of attached individual blades extending radially outward therefrom and rotating therearound, and a drive shaft having a first end perpendicularly attached to said pivot head;

means for imparting rotational movement to said rotary blade unit in engagement with a second end of said drive shaft, said rotational movement imparting means mounted on said moveable base member outside of said mixing vessel;

a conduit for conveying intermediate and final process material away from said mixing vessel, said conduit having a first end connected to said mixing vessel exit port;

at least one particle sizing device mounted on said moveable base member, said particle sizing device having an inlet in fluid communication with a second end of said process material conveying conduit and at least one diverter outlet, said diverter outlet having a first branch in fluid communication with said intermediate process material inlet port of said mixing vessels in said exterior wall of said mixing vessel and a second branch adapted to discharge process material away from said movable base member; and at least one process material recirculation device mounted on said moveable base member and located in fluid communication with said process material conveying conduit, said process material recirculation device capable of conveying process material containing suspended solids in an amount between about 20% and about 80% by total composition weight through a circuit defined by said mixing vessel, said process material conveying conduit, said particle sizing device, and said first branch of said diverter outlet.

2. The processing unit of claim 1 wherein said process material recirculation device comprises:

at least one pump located in said process material conveying conduit upstream of said particle sizing device;

a solids filter located in said process material conveying conduit immediately upstream of said pump, said solids filter having a mesh size ¼" or less.

3. The processing unit of claim 2 wherein said process material conveying conduit comprises a plurality of flexible junction tubing located at points intermediate between said mixing vessel and a pumping mechanism, said pumping mechanism and said particle sizing device, and said particle sizing device and said mixing vessel.

4. The processing unit of claim 1 wherein said mixing vessel further comprises:

at least one baffle mounted on said inner surface of said cylindrical side wall of said mixing vessel extending inward therefrom into said interior mixing area, said baffle contacting a portion of said process material contained in said mixing vessel as said process material is being agitated by said mixing mechanism further inducing turbulent movement therein.

5. The processing unit of claim 4 wherein said particle sizing device further comprises:

a housing having an inlet in fluid communication with said second end of said process material conveying conduit and an outlet; and a maceration unit mounted in said housing, said maceration unit powered by an external power source and capable of reducing particle size of solid process material received through said housing inlet and brought into contact therewith to a level at which a significant portion of said solid material is suspendable in said process material stream.

6. The processing unit of claim 5 wherein said moveable base member comprises:

a frame having a pair of parallel, longitudinally disposed beam members, a pair of latitudinally disposed members connected perpendicularly to said longitudinally disposed beam members, and a plurality of reinforcement braces extending therebetween;

a planar floor overlaying and mounted on said frame; and a fluid-tight containment region mounted on said planar floor, the fluid-tight containment region comprising a plurality of upwardly-extending wall members oriented perpendicular to said planar floor and sealingly connected thereto, said upwardly extending wall members having a sufficient height to define a container with an interior volume greater than that of all fluid-containing devices contained thereon; and wherein said mixing vessel further comprises a mounting means, said mounting means comprising a plurality of reinforced leg braces permanently attached to said outer wall surface of said mixing vessel at an upper end, and permanently attached to the moveable base member at a lower end, thereby elevating the mixing vessel above the moveable base member to a predetermined height.

7. The processing unit of claim 1 further comprising:

means for introducing suspension-enhancing agents into said process material stream, said introduction means including a suspension agent inlet port located in said side wall of said mixing vessel, a suspension agent feeder releasably connectible to said inlet port, a suspension agent storage receptacle in fluid communication with said feeder;

a solids conveying device mounted on said movable base member, said solids conveying means in removable contact with a separate solids inlet port in said mixing vessel and with an external source of solid feedstock material, said solid feedstock material containing between about 30% and about 70% by weight solid, the remainder being liquid; and a diluent conveying device mounted on said moveable base member, said diluent conveying device being in fluid communication with said mixing vessel and with an external diluent storage receptacle.

* * * * *